US005238158A

United States Patent [19]

Yamamoto et al.

[11] Patent Number: 5,238,158

[45] Date of Patent: Aug. 24, 1993

[54] IMMERSION NOZZLE EXCHANGING APPARATUS

[75] Inventors: Kenji Yamamoto, Akaiwa; Shigeru Ando, Bizen; Tadao Taniguchi, Bizen; Mototsugu Osada, Bizen, all of Japan

[73] Assignee: Shinagawa Refractories Co., Ltd., Tokyo, Japan

[21] Appl. No.: 784,401

[22] Filed: Dec. 23, 1991

[30] Foreign Application Priority Data

May 23, 1990 [JP] Japan ..... 2-133234

[51] Int. Cl.[5] ..... B22D 41/56

[52] U.S. Cl. ..... 222/607; 266/269

[58] Field of Search ..... 222/606, 607, 591; 266/236, 269, 271, 142, 143

[56] References Cited

U.S. PATENT DOCUMENTS 5,114,123 5/1992 Pfyl ..... 222/607

FOREIGN PATENT DOCUMENTS 58-66065 5/1983 Japan .
60-68144 4/1985 Japan .
61-172660 4/1986 Japan .
64-5660 1/1989 Japan .

*Primary Examiner*—Scott Kastler
*Attorney, Agent, or Firm*—Kanesaka and Takeuchi

[57] ABSTRACT

This invention concerns an apparatus for enabling exchange of an immersion nozzle seated in a tundish and used for casting of a molten metal from a molten metal container to be carried out very easily and quickly, which apparatus comprises rails (4) laid so as to approximate closely to a molten metal casting outlet nozzle (2) of a molten metal container (1), a self-propelling truck (5) adapted to travel on the rails (4), retainer parts (7) mounted on the truck (5) and adapted to retain an immersion nozzle (3) at the leading terminal thereof, and a movable arm (6) provided with a cleaning device (18) for cleaning the lower terminal surface of the outlet nozzle (2) after removal of a used immersion nozzle.

7 Claims, 3 Drawing Sheets

IMMERSION NOZZLE EXCHANGING APPARATUS

TECHNICAL FIELD

This invention relates to an immersion nozzle exchanging apparatus for attachment and detachment of an immersion nozzle to be used in casting a molten metal from a molten metal container such as a tundish.

BACKGROUND OF THE INVENTION

One example of the immersion nozzle exchanging apparatus of this kind is disclosed in Japanese Utility Model Publication SHO 57(1982)-54,919. The immersion nozzle exchanging apparatus of this patent specification is constructed by setting a vertically operable cylinder on a supporting member fixed on the lateral wall or the bottom of a tundish or in a slide gate valve equipment, for example, attaching hardware to the leading terminal of a piston rod of the cylinder in such a manner as to be freely rotated in the horizontal direction, interlocking a supporting arm slidably and rotatably to the hardware, and providing immersion nozzle fixtures at the opposite terminal parts of the supporting arm.

Since the conventional immersion nozzle exchanging apparatus is fixed to a tundish or a slide gate valve equipment, the attchment or detachment of an immersion nozzle to or from the immersion nozzle exchanging apparatus requires a worker to approach the tundish and work in a hot atmosphere. The safety of this work, therefore, is extremely dubious. The apparatus also has a fault in respect that the immersion nozzle is deficient in the ability to closely attach the nozzle to the tundish because a jointing material such as mortar or packings and metal adhering to the outlet nozzle of the tundish defy removal.

DISCLOSURE OF THE INVENTION

The immersion nozzle exchanging apparatus of this invention which is designed for the exchange of an immersion nozzle to be used in the casting of a molten metal from a molten metal container comprises rails laid so as to approximate closely to an outlet nozzle to be used for the casting of a molten metal from the molten metal container, a self-propelling truck adapted to travel on the rails, retainer parts mounted on the self-propelling truck and adapted to retain the immersion nozzle at the leading terminal thereof, and a movable arm furnished with a cleaning device for cleaning the lower terminal surface of the outlet nozzle after removal of a used immersion nozzle.

The immersion nozzle exchanging apparatus which preferably embodies this invention is provided at the leading terminal of the movable arm with a first retainer part for retaining a used immersion nozzle and a second retainer part for retaining an immersion nozzle to be attached to the lower terminal of the outlet nozzle.

The immersion nozzle exchanging apparatus which preferably embodies this invention is provided at the leading terminal of the movable arm with a block so as to be extended in a horizontal direction perpendicular to the longitudinal direction of the movable arm, with the first retainer part disposed on one terminal side in the extended direction of the block and the second retainer part disposed on the other terminal side thereof.

The immersion nozzle exchanging apparatus which preferably embodies this invention is provided with the cleaning device in the medial part of the block relative to the extended direction thereof.

The first retainer part which is used in the immersion nozzle exchanging apparatus which preferably embodies this invention comprises a pair of plates and grooves formed in the respective upper surfaces of the plates.

The first retainer part which is used in the immersion nozzle exchanging apparatus which preferably embodies this invention is provided with a pair of forks, each of which is are each provided in the leading terminal part thereof with a slanted surface intended to form an inclination in the direction of the basal terminal thereof and in the basal terminal part thereof with a horizontal surface.

In the immersion nozzle exchanging apparatus of this invention which is constructed as described above, the work of exchanging an immersion nozzle enjoys high safety and permits labor saving because this work can be performed at a position separated from the tundish.

In the exchange of the immersion nozzle fitting or sealing property of the immersion is improved because the cleaning device is capable of removing the jointing material such as mortar or packings and the metal from the lower terminal surface of the outlet nozzle on the tundish side.

BEST MODE OF EMBODIMENTS OF THE INVENTION

Now, the embodiments of this invention will be described below with reference to the accompanying drawings.

Figure 1:
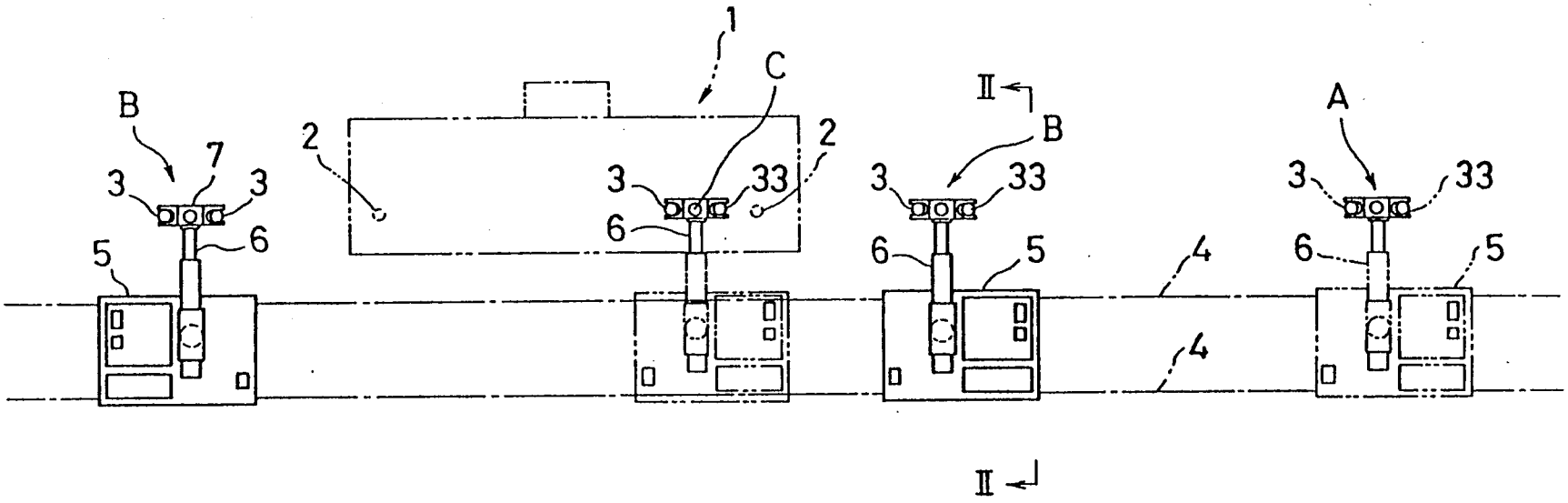
FIG. 1 is an overall plan view illustrating an apparatus embodying this invention.
Figure 2A:
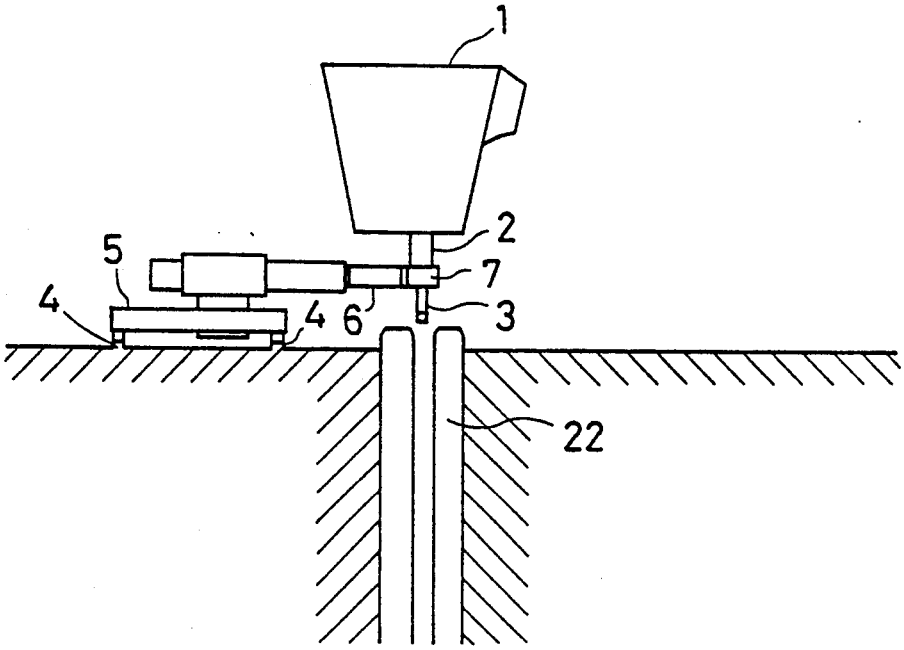
FIG. 2A is a cross section taken along line II—II in FIG. 1.
Figure 2B:
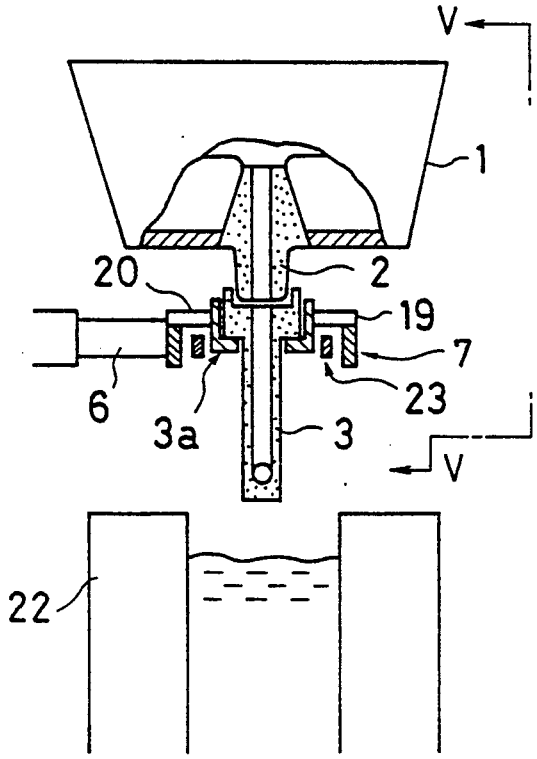
FIG. 2B is a magnified diagram of the essential part of the cross section of FIG. 2A.

With reference to FIG. 1 and FIGS. 2A and 2B, an immersion nozzle 3 is attached to and detached from the lower terminal of an outlet nozzle 2 of a tundish 1.

Rails 4 are laid so as to approximate closely to the outlet nozzle 2 of the tundish 1. A self-propelling truck 5 is set on the rails so as to travel between a retracting position A and an immersion nozzle exchanging position C. This self-propelling truck 5 is provided with a movable arm 6 disposed in a lateral direction perpendicular to the direction of travel of the self-propelling truck 5. The movable arm 6 is provided at the leading terminal thereof with a block 7 for supporting the immersion nozzle 3, a cleaning device 18 for cleaning the lower terminal surface of the outlet nozzle 2, etc.

The arm 6 is capable of freely advancing, retracting, fanning, and tilting and further capable of being vertically reciprocated by means of a cylinder (not shown).

Figure 3:
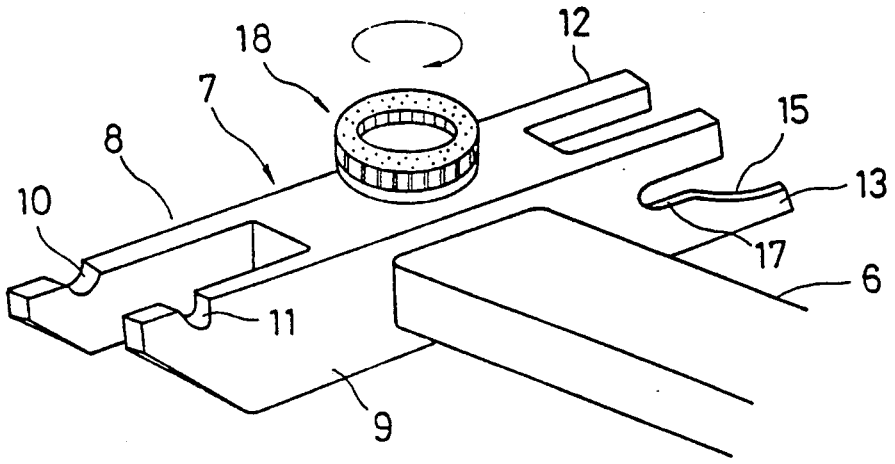
FIG. 3 is a perspective view of the leading terminal part of an arm.

As illustrated in FIG. 3, the arm 6 is provided at the leading terminal thereof with the block 7 which is disposed so as to extend in a horizontal direction perpendicular to the longitudinal direction of the arm 6. The block 7 is provided at one terminal side in the longitudinal direction thereof with a pair of plates 8, 9 having vertical surfaces and extending in a direction perpendicular to the extending direction of the arm 6. On the upper surfaces of these plates 8, 9 are provided immersion nozzle retainer parts severally furnished with grooves 10, 11.

On the side opposite to the plates 8, 9, a pair of forks 12, 13 are extended from the block 7. These forks 12, 13 are provided with immersion nozzle retaining parts incorporating respectively therein slanted surfaces 14, 15 (the slanted surface 14 not shown in FIG. 3) inclined upwardly in the direction of block 7 and horizontal parts 16, 17 (the horizontal part 16 not shown in FIG. 3). On the upper surface of the block 7, a cleaning device 18 provided with a rotary wire brush or a sharpening stone having the axis of rotation in the vertical direction and adapted to clean the lower terminal surface of the outlet nozzle is installed.

Figure 4:
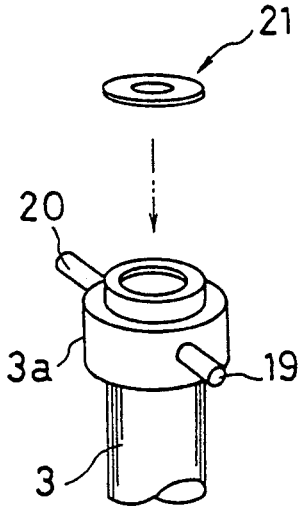
FIG. 4 is a perspective view of the upper part of an immersion nozzle.
Figure 5:
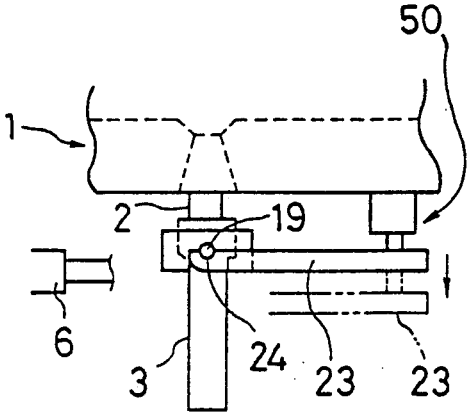
FIG. 5 is a cross section taken along line V—V in FIG. 2B.

The immersion nozzle 3, as illustrated in FIG. 4, is provided on the upper terminal thereof with a holder 3*a* from which pins 19, 20 are projected in a diametric direction. The immersion nozzle 3 is retained in the leading terminal part of the arm 6 in such a manner that the pins 19, 20 lie astraddle the grooves 10, 11 or the horizontal parts 16, 17. Denoted by 21 is a packing.

In FIGS. 2A and 2B, 22 stands for a mold. In the lower terminal part of the tundish 1, a lower nozzle (immersion nozzle) fixing cylinder device 50 as disclosed in Japanese Utility Model Publciation SHO 63(1988)-31819 titled "Lower nozzle fixing device for molten metal container" is seated. A support 23 is extended from the cylinder device 50 to a level below the outlet nozzle 2. This support 23 is vertically reciprocated by the cylinder device 50. The support 23 is provided with a depressed part 24 in which the pins 19, 20 of the immersion nozzle 3 are set. The immersion nozzle 3 is supported by the support 23 by the fact that the pins 19, 20 thereof are hooked in the depressed part 24. The joining of the immersion nozzle 3 with the outlet nozzle 2 is attained by the pulling of the support 23 by the cylinder device 50.

The operation for exchange of the immersion nozzle 3 by the use of the immersion nozzle exchanging apparatus constructed as described above will be described below. At first, the self-propelling truck is located at the retracting position A shown in FIG. 1, where a used immersion nozzle 3 taken out of the tundish 1 is removed. Then, the self-propelling truck is moved to the waiting position B, where it is loaded with an immersion nozzle 3 to be newly attached to the tundish 1 and then kept waiting.

The removal of the used immersion nozzle 33 from the tundish 1 requires the tundish 1 to be elevated to a height at which the used immersion nozzle 33 does not collide against the upper surface of the cover for the mold 22. Subsequently, the immersion nozzle fixing cylinder device 50 is set into motion to move the used immersion nozzle 33 downwardly from the set position (the position at which the outlet nozzle 2 is attached) to separate the same. The block 7 of the immersion nozzle exchanging apparatus is moved closely to the support 23 of the immersion nozzle fixing cylinder device of the mold 22. Then, the worker sets the packing 21 on the immersion nozzle 3 newly supplied as supported on the block 7. Subsequently, the arm 6 is moved so that the slanted surfaces 14, 15 of the forks 12, 13 may be interlocked with the pins 19, 20 of the used immersion nozzle 33 supported by the support 23. As a result, the used immersion nozzle 33 supported by the support 23 is lifted and liberated from the support 23. Finally, after the pins 19, 20 have been joined to the horizontal parts 16, 17, the removal of the used immersion nozzle 33 is attained by retracting the arm 6 from under the outlet nozzle 2. Thereafter, the cleaning of the lower terminal surface of the outlet nozzle 2 is effected by causing the rotary wire brush or sharpening stone 18 to be placed below the outlet nozzle 2, pressing the rotary wire brush or sharpening stone 18 against the lower terminal surface of the output nozzle 2, and setting it into rotation. After this cleaning is finished, the setting of the newly supplied immersion nozzle 3 is accomplished by moving the newly supplied immersion nozzle 3 retained the grooves 10, 11 of the plates 8, 9 to the nozzle center position of the outlet nozzle 2 and allowing the pins 19, 20 to be hooked by the support 23.

Then, the immersion nozzle fixing cylinder device 50 is put to operation and, as a result, the support 23 is moved upwardly and the immersion nozzle 3 is joined to the lower terminal of the outlet nozzle 2 and immobilized there.

Thereafter, the self-propelling truck 5 having the used immersion nozzle 33 retained fast thereon is returned to the retracting position A.

As described above, the attachment and detachment of the immersion nozzles 3, 33 to and from the leading terminal part of the arm 6 can be carried out under remote control. This work of exchanging the immersion nozzles 3, 33, therefore, enjoys high safety and permits labor saving unlike the work which is performed near the mold. Further, since the rotary wire brush or sharpening stone 18 cleans the lower terminal surface of the outlet nozzle 2, close mutual fixing is established between the outlet nozzle 2 and the immersion nozzle 3 and the casting can be carried out in a mold with high sealing property.

INDUSTRIAL APPLICABILITY

In accordance with the immersion nozzle exchanging apparatus of this invention, since the work of exchanging the immersion nozzles relative to the tundish can be carried out substantially automatically as described above, the work enjoys ideal operational efficiency and permits labor saving and the work in a hot atmosphere similarly enjoys very high safety. Moreover, in the apparatus of this invention, since the mutual sealing ability of the outlet nozzle and the immersion nozzle is attained with conspicuously improved closeness, the mold defies leakage of air and the cast metallic article consequently acquires improved quality.

We claim:

1. An immersion nozzle exchanging apparatus adapted to exchange an immersion nozzle attached to an outlet nozzle of a molten mental container, comprising:

rails extending from a first position near the molten metal container to a second position away from the molten metal container, a self-propelling truck situated on the rails to travel between the first and second positions, and a movable arm mounted on the self-propelling truck and having a leading terminal with a block, said block including a first retainer part situated at one side and adapted to receive a used immersion nozzle thereon, said first retainer part being formed of a pair of plates spaced apart from each other, each plate having a leading part with a slanted surface and a basal part with a horizontal surface, said slanted surface being inclined upwardly from the leading part to the basal part so that when the first retainer part is laterally moved for removal of the used immersion nozzle, the used immersion nozzle is lifted upwardly along the slanted surface and held by the basal part to thereby easily disengage the used immersion nozzle; a second retainer part situated at a side opposite to the first retainer part and adapted to retain a new immersion nozzle thereon to be attached to the outlet nozzle; and a cleaning device for cleaning the outlet nozzle after removing the used immersion nozzle and before attaching the new immersion nozzle, said cleaning device being situated between the first and second retainer parts.

2. An immersion nozzle exchanging apparatus according to claim 1, wherein said immersion nozzle includes pins extending outwardly in a diametric direction of the immersion nozzle, and said molten metal container includes a support with two arms for supporting the pins to fix the immersion nozzle to the outlet nozzle, said pair of plates of the first retainer part holding and supporting the pins.

3. An immersion nozzle exchanging apparatus according to claim 2, wherein a distance between the arms of the support is different from a distance between the pair of plates of the first retainer part so that when the first retainer part is disposed adjacent to the arms of the support to exchange the immersion nozzle, the pins are lifted at the slanted surfaces and are stably located on the basal part.

4. An immersion nozzle exchanging apparatus according to claim 3, wherein each plate of the first retainer part has a shape of a fork having upper and lower portions with a groove therebetween, said leading part and the basal part being formed on the lower portion.

5. An immersion nozzle exchanging apparatus according to claim 4, wherein said second retainer part includes a pair of plates with grooves for retaining the pins of the new immersion nozzle.

6. An immersion nozzle exchanging apparatus according to claim 1, wherein said first and second retainer parts and the cleaning device are arranged linearly and disposed perpendicular to a longitudinal axis of the arm.

7. An immersion nozzle exchanging apparatus according to claim 6, wherein said cleaning device includes one of a rotary brush and a sharpening stone.

* * * * *